United States Patent [19]

Cantrel

[11] 4,314,778

[45] Feb. 9, 1982

[54] FRICTION ROCK STABILIZER AND METHOD FOR INSERTING THEREOF IN AN EARTH STRUCTURE BORE

[75] Inventor: James F. Cantrel, Easton, Pa.

[73] Assignee: Ingersoll-Rand Co., Woodcliff Lake, N.J.

[21] Appl. No.: 233,975

[22] Filed: Feb. 12, 1981

Related U.S. Application Data

[63] Continuation of Ser. No. 95,375, Nov. 19, 1979.

[51] Int. Cl.[3] ..... E21D 21/00; E21D 20/00

[52] U.S. Cl. ..... 405/259; 411/60

[58] Field of Search ..... 405/259–262; 29/446, 448, 449, 451, 453, 229, 223, 235; 138/97; 411/15–28, 32–34, 353; 285/370, 397, 214, 421, 216; 403/344, DIG. 7, 374, 409

[56] References Cited

U.S. PATENT DOCUMENTS

| | | | |
|---|---|---|---|
| Re. 30,256 | 4/1980 | Scott | 405/259 |
| 719,817 | 2/1903 | Kunze | 29/453 U X |
| 2,177,231 | 10/1939 | Tinnerman | 29/229 U X |
| 2,180,271 | 11/1939 | Arras | 29/229 X |
| 2,258,911 | 10/1941 | Skoko | 285/421 X |
| 3,425,757 | 2/1969 | Minor | 403/344 X |
| 3,701,555 | 10/1972 | Harris | 403/409 X |
| 4,109,684 | 8/1978 | Fernandez | 29/451 X |
| 4,142,704 | 3/1979 | Murray | 411/353 |

*Primary Examiner*—Dennis L. Taylor

*Attorney, Agent, or Firm*—David W. Tibbott; Bernard J. Murphy

[57] ABSTRACT

The stabilizer, according to a preferred embodiment thereof, comprises a generally tubular body which is axially slit, according to the prior art. According to the invention, the surfaces of the body immediately adjacent to the slit have ribs formed thereon which define bearing surfaces for clamping together, to draw the surfaces together, closing the slit, and thereby contract the stabilizer to facilitate its insertion into an undersized bore. The novel method, then, comprises contracting an axially slit friction rock stabilizer by engaging the aforesaid ribs (formed thereon) with a tool, to contract the stabilizer to a reduced and constrained cross-sectional dimension, inserting the stabilizer into an undersized bore, and releasing it therein, in order that it may engage and stabilize the surface of the bore (of the earth structure).

4 Claims, 4 Drawing Figures

FRICTION ROCK STABILIZER AND METHOD FOR INSERTING THEREOF IN AN EARTH STRUCTURE BORE

This application is a continuation of application Ser. No. 95,375, filed Nov. 19, 1979.

This invention pertains to friction rock stabilizers, and methods for insertion of such in earth structure bores, and particularly to an improved friction rock stabilizer so configured as to facilitate its contraction to render its insertion into an undersized earth structure bore more facile, and to a method for insertion of friction rock stabilizers into undersized earth structure bores.

BACKGROUND OF THE INVENTION

Friction rock stabilizers are relatively new earth structure stabilizing devices, and such are best exemplified by U.S. Pat. No. 3,922,867, issued Dec. 2, 1975, and U.S. Pat. No. 4,012,913, issued Mar. 22, 1977, both granted to James J. Scott.

According to the teachings in the referenced Patents, friction rock stabilizers comprise generally tubular bodies which may be axially slit, and which have a free cross-sectional dimension predetermined to be larger than the transverse dimension of the earth structure bores into which they are to be inserted. Accordingly, it requires considerable thrusting force to insert such a stabilizer into an undersized bore. The stabilizer must contract, to accommodate insertion, whereby the slit is substantially closed during insertion and, after insertion, the stabilizer attempts to return to its original free dimension; thus it frictionally holds fast to the wall of the bore and, consequently, stabilizes the earth structure.

In addition to the aforesaid U.S. patents granted to Scott, there is another prior art publication of interest. The latter is the Republic of South Africa patent specification No. 78/5306; it was published in the Republic of South Africa Patent Journal of August 1979. This South African specification is alleged to have a filing date priority based on a Swedish patent application No. 7711060-9 of Oct. 3, 1977. The Republic of South Africa specification recites a method of inserting a "friction roof bolt" in a hole in a roof or side wall of an underground opening for anchoring the roof or side wall, said bolt comprising a generally annular body from end-to-end having a slot through its thickness and being arranged to permit radial compression, wherein a hole is formed in the roof or side wall having a diameter which is smaller than that of said body when the body is in a noncompressed state, characterized by the steps of radially compressing said body to a diameter somewhat smaller than the diameter of the hole, fixing said body in the compressed state, inserting the compressed body in the hole, and causing the body to expand to engage the surrounding wall of the hole upon being inserted in the hole.

The aforesaid Republic of South Africa specification defines a method not too dissimilar to my herein-disclosed inventive method which comprises inserting a friction rock stabilizer in a bore formed in an earth structure, for stabilizing the structure, wherein the bore has a given transverse dimension, and the stabilizer has a first, free, relaxed transverse dimension which is greater than said given dimension and is resiliently contractible to a second, constrained, transverse dimension which is slightly less than said given dimension of said bore, comprising the steps of slidably engaging the stabilizer with a device to cause contraction of the stabilizer to said second, constrained, transverse dimension; inserting the contracted stabilizer into the bore; and disengaging the device to permit a release of the stabilizer from its contracted constraint.

The Republic of South Africa specification's method and my own differ in at least one, material respect, however. My method, as will be clear from the ensuing text, comprises the slidable engagement of the stabilizer with a contracting device and, patently offers a facile method of contracting the bore-inserted stabilizer again, subsequently, for withdrawal thereof from a bore. It is frequently desirable to remove a bore-inserted stabilizer to study the effects of corrosion, abrasion, etc. visited on the stabilizer. Hence, my method owns this desirable reversibility. The Republic of South Africa specification disclosed method comprises an irreversible stabilizer insertion as, in the embodiments thereof, it requires the severing of contraining bands following insertion. After the bands have been severed, no way is offered for again contracting the stabilizer to permit its removal from a bore.

BRIEF SUMMARY OF THE INVENTION

It is an object of this invention to disclose both a friction rock stabilizer having means formed thereon to facilitate a pre-insertion contraction thereof for contracted installation in an undersized bore, and also a method comprising the pre-insertion contraction, insertion, and contraction release of friction rock stabilizers.

Particularly, it is an object of this invention to set forth a friction rock stabilizer for insertion in a bore formed in an earth structure for stabilizing the structure, comprising a generally tubular body; said body having an elongate axis and wall means for frictionally engaging the surface of an earth structure bore; said body further having a first, free, relaxed, transverse dimension predetermined to be larger than the transverse dimension of a bore into which it is to be inserted; and said body also having an axially-extended slit formed through said wall means thereof to permit said body to assume a second, constrained, transverse dimension which is smaller than both said first transverse dimension and the transverse dimension of a bore into which it is to be inserted; wherein said wall means has confronting axially-extended and spaced-apart surfaces which: (1) define said slit therebetween, and (2) have key means formed adjacent to said slit-defining surfaces for: (a) receiving contraction forces thereat, and (b) responsive to such forces, for moving said slit-defining surfaces toward each other.

Another object of this invention is to set forth a friction rock stabilizer, for insertion in a bore formed in an earth structure for stabilizing the structure, comprising a generally tubular body; said body having an elongate, central axis and wall means for frictionally engaging the surface of and earth structure bore; said body also having means defining an axially-extended separation, of a given width, in a said wall means; and means defining a pair of spaced-apart bearing surfaces, integrally formed on said body and movable relative to each other to vary said separation to a width other than said given width.

It is also a further object of this invention to teach a method of inserting a friction rock stabilizer in a bore formed in an earth structure, for stabilizing the structure, wherein the bore has a given transverse dimension, and the stabilizer has a first, free, relaxed, transverse dimension which is greater than said given dimension and is resiliently contractible to a second, constrained, transverse dimension which is slightly less than said given dimension of said bore, comprising the steps of slidably engaging the stabilizer with a device to cause contraction of the stabilizer to said second, constrained, transverse dimension; inserting the contracted stabilizer into the bore; and disengaging the device to permit a release of the stabilizer from its contracted constraint.

Further objects of this invention, as well as the novel features thereof, will become more apparent by reference to the following description, taken in conjunction with the accompanying figures.

DETAILED DESCRIPTION

Figure 1:
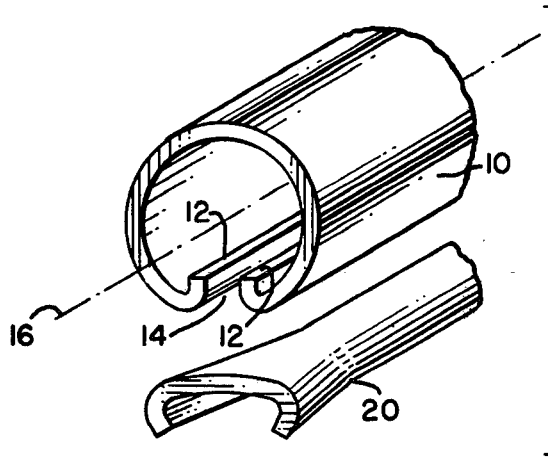
FIG. 1 is an isometric projection of an end portion of a friction rock stabilizer, according to an embodiment of the invention, and a clamping device for use therewith.
Figure 2:
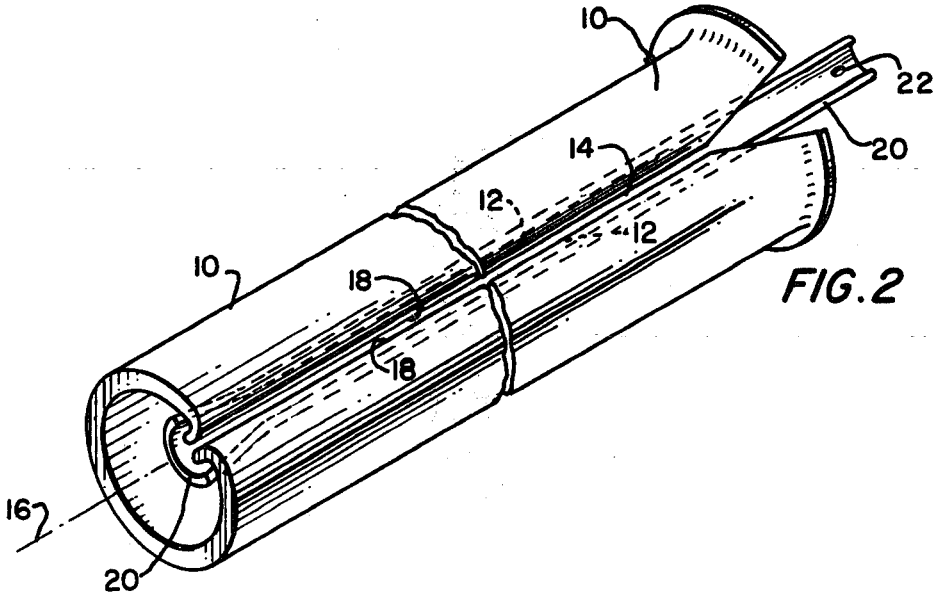
FIG. 2 is a discontinuous isometric projection of the stabilizer and clamping device of FIG. 1 shown in operative, engaged relationship.

According to the referenced U.S. Pat. No. 3,922,867, an embodiment of a friction rock stabilizer may have an axially-extended slit formed therein. Such a stabilizer 10 is shown in FIGS. 1 and 2 and according to this inventive embodiment, has the edges 12 of the slit 14 thereof turned inward generally toward the central axis 16 thereof. According to the invention, the stabilizer 10 is forceably contracted, to move confronting surfaces 18 thereof toward each other, and to dispose the edges 12 as bearing surfaces or keys. Thus, the edges 12 slidably receive a clamping device 20. The device 20, of substantially U-shaped cross-section, has a flared or widened end 21 which has a width sufficient to straddle and slidably engage the edges 12 at one end of the stabilizer. Then, the device 20 is forced along the stabilizer 10, axially, to move the surfaces 18, into proximity, as aforesaid. The stabilizer 10, then, being substantially closed along the slit 14, the edges 12 lie as closely-coupled, parallel ribs. The device 2, slidably and axially engaged with the edges 12, functions as keyway to hold the "key" edges 12 in close coupling and, resultingly, the stabilizer 10 in contracted position. Now then, the stabilizer 10, for having a cross-sectional or transverse dimension slightly less than the earth structure bore in which to be installed, can be freely and slidably fitted therein. Upon the contracted stabilizer 10 being installed into the bore, it can be relaxed to return toward its free, transverse dimension. To accommodate for this, the contraction or clamping device 20 has an aperture 22, formed through the lower end, which may be grasped by a tool. Simply by slidably withdrawing the device 20, it comes free of the stabilizer 10, and the latter expands outwardly to engage the bore wall.

In U.S. Pat. No. 4,012,913, patentee Scott set forth an alternative embodiment of his friction rock stabilizer in which the edges of the slit therein are or may be overlapped.

Figure 4:
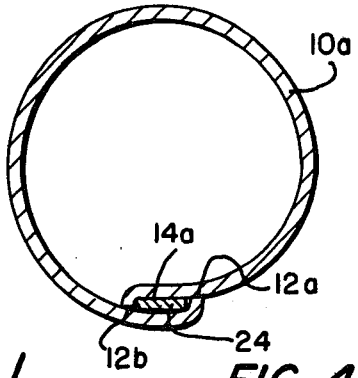
FIG. 4 is a cross-sectional view taken along Section 4—4 of FIG. 3.
Figure 3:
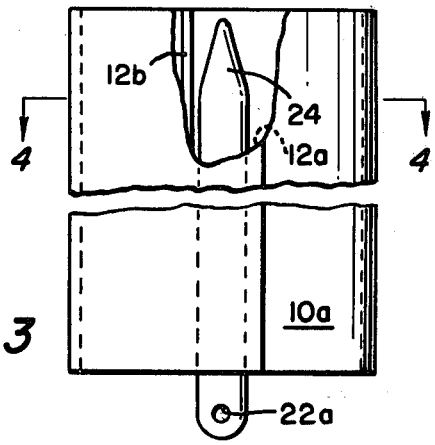
FIG. 3 is a discontinuous, elevational view of an alternative embodiment of a friction rock stabilizer, according to the invention, showing an alternative contracting tool in use therewith.

In FIGS. 3 and 4 I disclose an alternative embodiment 10*a* of a stabilizer according to the invention, drawn on the type of stabilizer depicted in said U.S. Pat. No. 4,012,913. Herein I turn the edges 12*a* and 12*b* of the "overlapped" slit 14*a* in opposite directions so that the edges define parallel and confronting ribs. Then by inserting a spacer blade 24 therebetween, the rib-defining edges 12*a* and 12*b* are forced apart, resulting in a contraction of the stabilizer 10*a*. Again, following earth structure bore insertion of the thereby contracted stabilizer 10*a*, it remains only to withdraw the blade 24, by means of the tool-aperture 22*a*, to allow the confronting edges 12*a* and 12*b* to close toward each other, so that the stabilizer 10*a* might return towards its free dimension.

Corrosive mine environments pose serious problems and, as a consequence, it is frequently deemed advisable to apply a corrosion-protective coating to the stabilizers 10 and 10*a*. However, the prior art-practiced method of installing stabilizers into undersized bores, by applying the considerable and necessary thrusting force, destroys any stabilizer coatings. The wall of the bore simply scrapes off the coated surface. It is for this reason that my novel method of stabilizer insertion is particularly beneficial. The coated stabilizer is contracted to a dimension of less than that of the bore, so that the bore will not have any significant, abrasive contact with the coating during stabilizer insertion. Then, the stabilizer is merely allowed to expand, and the coating closes into an undisturbed contact with the bore wall.

While I have described my invention in connection with specific embodiments thereof, and methods of practice, it is to be clearly understood that this is done only by way of example, and not as a limitation to the scope of my invention as set forth in the objects thereof and in the appended claims.

I claim:

1. A friction rock stabilizer, for insertion in a bore formed in an earth structure for stabilizng the structure comprising:

a generally tubular body;

said body having an elongate central axis and wall means for frictionally engaging the surface of an earth structure bore;

said body further having a first, free, relaxed, transverse dimension predetermined to be larger than the transverse dimension of a bore into which it is to be inserted, and an axial length which is considerably greater than said transverse dimension; and said body also having an axially-extended slit formed through said wall means thereof to permit said body to assume a second, constrained, transverse dimension which is smaller than both said first transverse dimension and the transverse dimension of a bore into which it is to be inserted; wherein said wall means has overlapping, axially-extended and spaced-apart surfaces which: (1) define said slit therebetween, and (2) have axially extended, substantially parallel ribs formed adjacent to said surfaces for: (a) receiving contraction forces thereat, and (b) responsive to such forces, for moving said ribs away from each other ; wherein said ribs project substantially radially, relative to said elongate axis, and extend axially along substantially the full length of said body; and at least one of said ribs projects inwardly, from said wall means, generally toward said axis of said body.

2. A friction rock stabilizer, according to claim 1, wherein:

said ribs are a pair and one thereof projects outwardly, from said wall means, away from said axis of said body.

3. A friction rock stabilizer, according to claim 1, further including:

clamping means, slidably and removably engaged with said wall means, constraining said body in contraction, whereby said body manifests said second, constrained dimension.

4. A friction rock stabilizer, according to claim 3, wherein:

said clamping means comprises a tool slidably engaged with said ribs.

* * * * *